US006755313B1

(12) United States Patent
Kishimoto et al.

(10) Patent No.: US 6,755,313 B1
(45) Date of Patent: Jun. 29, 2004

(54) OVERHEAD TRAVELING CRANE SYSTEM

(75) Inventors: Shiko Kishimoto, Amagasaki (JP); Katsuto Ito, Hitachi (JP); Yoshihiro Naka, Amagasaki (JP)

(73) Assignee: Nippon Mining & Metals, Co., Ltd., Tokyo (JP)

( * ) Notice: Subject to any disclaimer, the term of this patent is extended or adjusted under 35 U.S.C. 154(b) by 0 days.

(21) Appl. No.: 09/700,241

(22) PCT Filed: May 14, 1999

(86) PCT No.: PCT/JP99/02497

§ 371 (c)(1),
(2), (4) Date: Oct. 9, 2001

(87) PCT Pub. No.: WO99/58440

PCT Pub. Date: Nov. 18, 1999

(30) Foreign Application Priority Data

May 14, 1998 (JP) ..... 10-132089

(51) Int. Cl.[7] ..... B66C 13/08
(52) U.S. Cl. ..... 212/273; 134/76
(58) Field of Search ..... 212/272, 273, 212/328, 330, 331; 134/76, 77

(56) References Cited

U.S. PATENT DOCUMENTS

| | | | | |
|---|---|---|---|---|
| 2,998,753 A | * | 9/1961 | Knaub et al. | |
| 3,033,381 A | * | 5/1962 | Noble et al. | |
| 3,034,659 A | * | 5/1962 | Willison et al. | |
| 3,386,592 A | * | 6/1968 | Reischl | |
| 3,552,587 A | * | 1/1971 | Warren | |
| 3,738,521 A | * | 6/1973 | Long | 214/658 |
| 3,943,725 A | * | 3/1976 | Pennock | 61/46.5 |
| 4,120,171 A | * | 10/1978 | Chateau et al. | 405/169 |
| 4,343,586 A | * | 8/1982 | Easley et al. | 414/414 |
| 4,662,300 A | * | 5/1987 | McCallum et al. | 212/147 |
| 5,228,961 A | * | 7/1993 | Sakai | 204/180.2 |
| 5,568,720 A | * | 10/1996 | Teich et al. | 57/281 |
| 5,649,636 A | * | 7/1997 | Baumann | 212/344 |
| 5,802,127 A | * | 9/1998 | Goldberg | 376/262 |
| 5,915,906 A | * | 6/1999 | Lucking et al. | 414/142.8 |

FOREIGN PATENT DOCUMENTS

| | | | |
|---|---|---|---|
| GB | 2014111 | * | 8/1979 |
| JP | 6-53351 | * | 7/1994 |
| JP | 9-249985 | * | 9/1997 |

* cited by examiner

*Primary Examiner*—Thomas J. Brahan
(74) *Attorney, Agent, or Firm*—Leighton K. Chon; Ostrager Chong & Flaherty (HI)

(57) ABSTRACT

An overhead traveling crane system has cylindrical guide members (16*d*, 18*d*) and guide bars (15*a*, 16*a*) installed on a moving device (18) and a lifting device (15), respectively. The guide bars (15*a*, 16*a*) are inserted nestably into the cylindrical guide members (16*d*, 18*d*) so [as to move] that the lifting device (15) can be raised and lowered by wires only substantially vertically relative to the moving device (18) when wires (15*b*, 16*b*) are wound up and down. The lower end parts of the cylindrical guide members (16*d*, 18*d*) are expanded in a flared shape so that the upper end parts of the guide bars (15*a*, 16*a*) can be moved minutely horizontally in the period between the start of engagement and the completion of engagement. Similarly, a flared position guide means may be provided on a lower part of the lifting device for engagement with positioning means located on the target on the ground. The lifting device (15) can thus be moved finely horizontally so that the position of the lifting device (15) can be accurately controlled horizontally.

6 Claims, 4 Drawing Sheets

OVERHEAD TRAVELING CRANE SYSTEM

This U.S. patent application claims the priority of PCT International Application No. PCT/JP99/02497, filed on May 14, 1999, which was based on the priority of Japanese Patent Application No. 10-132089, filed on May 14, 1998.

TECHNICAL FIELD

This invention relates to an overhead traveling crane system capable of accurately controlling the position of a lifting device horizontally, the lifting device being suspended from the overhead traveling crane system so it can be elevated over a target on the ground.

BACKGROUND ART

First, a description will be given of an outline of an electrolysis refinery facility (see FIG. 4). An electrolytic bath 30 is a rectangular parallelepiped tank which opens upward and has a common conductor (bush bar) 32 set up on an upper surface of a side wall 30*c* of the electrolytic bath 30. As is most clearly shown in FIG. 3, a plurality of electrolytic baths 30 are arranged side by side longitudinally and laterally, and they come to several hundreds of tanks in total. In each electrolytic bath 30, a plurality of cathode plates K (in the case of Cu, normally between 20 and 50 plates) and a plurality of anode plates A with lugs are soaked in an electrolytic fluid alternately in parallel. Each of the cathode plates K is suspended from a cathode support bar (cross bar) 34. Both ends of the cross bar 34 as well as the lugs of the anode plates A are supported on an upper surface of one of the left and right electrolytic bath side walls 30*c* and the common conductor provided on the other side wall 30*c*, respectively. In the electric current supply of a system as shown in FIG. 3, four electrolytic baths 30 consisting of two arranged longitudinally and two arranged laterally make one set, and are wired so that electric current flows from the anode plates A to the cathode plates K. Because an electrolysis refinery power source needs low voltage and a large amount of current and has, at the same time, a wide range of voltage adjustment depending on the condition of an electrolysis operation, a semiconductor rectifier of a thyristor system or a diode system is employed.

Primary factors that hamper normal operation of the electrolysis refinery include growth of a branch shaped crystal or a nodule on the cathode plate, warping of the cathode plate, and shorting caused by a big anode fragment. For example, if a nodule grows locally on the cathode plate and hypertrophies, anode plate A and cathode plate K will short-circuit, so that the electrolysis current concentrates on the short-circuited area, and the electrolysis refinery is hampered.

Tank inspection work to discover these errors are done by workmen walking on the electrolytic baths everyday. But this demands a great deal of labor because enormous numbers of parts must be inspected and workmen walking on the electrolytic baths may cause the position of an electrode plate to shift.

Accordingly, by utilizing the fact that the gain and loss of electric current and variation in magnetic flux have a certain relationship, it is possible to measure the magnetic-flux density of the cathode plates K and/or anode plates A with a magnetic sensor and detect change of the electric current and to thus detect error on the electrode plate. Furthermore, to make the inspection work automatic and measure the magnetic-flux density, it is possible to utilize an overhead traveling crane system for salvaging electrode plates, by suspending the lifting device from it, installing a plurality of magnetic sensors on this lifting device, and placing each of the magnetic sensors adjacent to the cathode plates K and/or anode plates A supported by common conductors.

To measure the magnetic-flux density of each of the electrode plates, it is required that the overhead traveling crane system accurately positions the magnetic sensors close to the given places of the cathode plates K and anode plates A.

However, with the general-purpose model of the overhead traveling crane system, in addition to transferring error like a rail construction error or a detector error, since there is only a little space between the system and each of the electrode plates (approximately 10 cm), it would normally be difficult to operate the overhead traveling crane system to accurately position the magnetic sensor suspended from the lifting device close to the cathode plates K and/or anode plates A.

To minimize the error, it is conceivable to carry out the construction of the rail more minutely and suppress any play of oblique and lateral wheel movement to the utmost. However, in practice, it is extremely difficult to do so in a facility where the rail may be several hundred meters long.

Moreover, even if precise positioning was possible, there is a problem of the lifting device swinging by the influence of inertia caused by the traveling of the crane itself. In this case, it is conceivable to suppress swinging by fuzzy motion control or the like, but this disadvantageously causes the overhead traveling crane system to move slower and become expensive.

Therefore, this invention has an object to provide an overhead traveling crane system capable of accurately controlling the horizontal position of a lifting device installed thereon while allowing for the traveling error of the general-purpose overhead traveling crane system.

The invention aims at providing an overhead traveling crane system capable of accurately controlling the horizontal position of a lifting device while securing a large traveling rate of the general-purpose overhead traveling crane and having low installation cost.

DISCLOSURE OF THE INVENTION

To solve the above-mentioned problems, the invention as described herein is an overhead traveling crane system wherein a moving device is arranged so as to be movable in a horizontal direction on an upper track, and a lifting device is suspended from the moving device through a wire so as to ascend and descend, and wherein position guide means attached to the lifting device can be engaged with positioning means installed on a target on the ground so that the lifting device can be lowered and positioned after horizontal movement. Cylindrical guide members are attached to the moving device so as to extend vertically and guide bars are attached to an upper surface of the lifting device so as to extend vertically to the guide members, such that the lifting device moves substantially in only a vertical direction with respect to the moving device at the time of winding up and down the wire by inserting the guide bars into the cylindrical guide members. The lower end parts of the cylindrical guide members are expanded in a flared shape so that the upper end parts of the guide bars can be moved a little horizontally in a period between start of engagement of the position guide means with the positioning means and completion of the engagement, whereby the lifting device can be moved finely horizontally so that the position of the lifting device can be accurately controlled horizontally.

In another embodiment, the present invention is an overhead traveling crane system wherein a moving device is arranged so as to be movable in a horizontal direction on an upper track, and a suspension member is suspended from the moving device through a first wire so as to ascend and descend, and wherein a lifting device is suspended from the suspension member through a second wire so as to ascend and descend, and position guide means attached to the lifting device can be engaged with positioning means installed on a target on the ground so that the lifting device can be lowered and positioned after horizontal movement thereof. First cylindrical guide members are attached to the moving device so as to extend vertically and first guide bars are attached to an upper surface of the suspension member so as to extend vertically to the guide members, such that the suspension member moves substantially in only a vertical direction with respect to the moving device at the time of winding up and down the first wire by inserting the first guide bars into the first guide members. Second cylindrical guide members are attached to the suspension member so as to extend upright and second guide bars are attached to an upper surface of the lifting device so as to extend vertically to the guide members, wherein the lifting device moves substantially in only the vertical direction with respect to the suspension member at the time of winding up and down the second wire by inserting the second guide bars into the second guide members. The lower end parts of the second guide members are expanded in a flared shape so that upper end parts of the second guide bars can be moved a little horizontally in a period between start of engagement of the position guide means with the positioning means and completion of the engagement, whereby the lifting device can be moved finely horizontally so that the position of the lifting device can be accurately controlled horizontally.

The positioning means installed on the target on the ground may have conical engaging members on an end portion thereof, and the position guide means attached to the lifting device may have concave parts that engage with the conical engaging members so that when the lifting device is lowered after horizontal movement, the concave parts provided on the position guide means are inserted over the conical engaging members, and then the lifting device can move minutely in a horizontal direction and is thus guided in a given position and engaged therewith, so that the lifting device can be positioned.

The positioning means installed on the target on the ground may have counter-cone-shaped engaging members on an end portion thereof, and the position guide means attached to the lifting device may have convex parts engaged with the counter-cone-shaped engaging members so that when the lifting device is lowered after horizontal movement, the convex parts provided on the position guide means are inserted in the counter-cone-shaped engaging members, and then the lifting device can move minutely in a horizontal direction and is thus guided in a given position and engaged therewith, so that the lifting device can be positioned.

The position guide means may also be attached to both ends of the lifting device.

One or more magnetic sensors may be suspended from and supported by the lifting device.

THE BEST MODE FOR CARRYING OUT THE INVENTION

Figure 1:
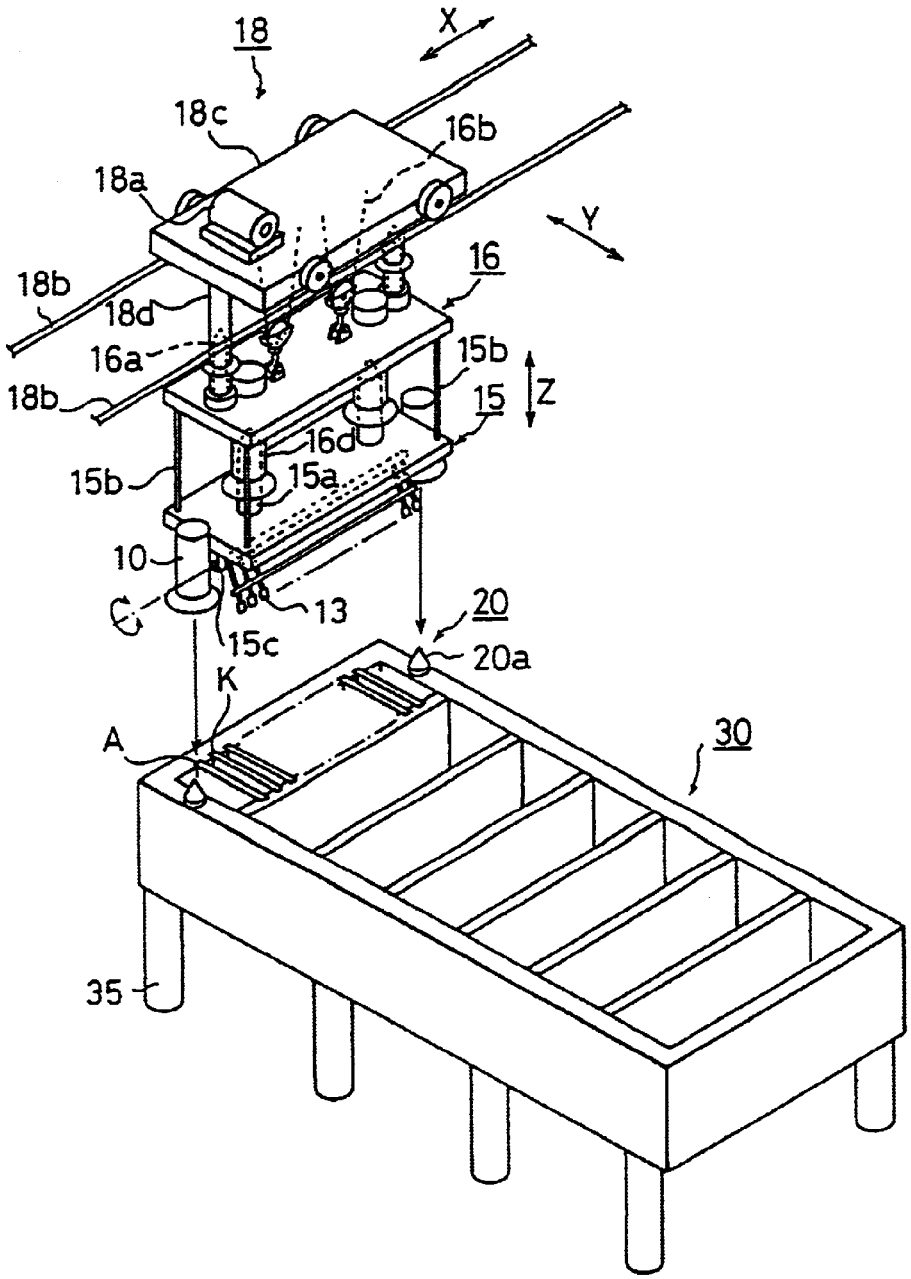
FIG. 1 is a schematic perspective view of an overhead traveling crane system of the present invention.

A detailed description will be given of an illustrated preferred embodiment of an overhead traveling crane system according to the present invention. FIG. 1 is a schematic perspective view of an overhead traveling crane of the present invention. A large number of electrolytic baths 30 arranged for Cu refinery are arranged in tanks with electrolysis fluid like dilute sulfuric acid. The electrolytic baths are framed and fixed as a whole, and are supported by a plurality of legs 35. Each electrolytic bath 30 has anode plates A serving as the anode electrodes and cathode plates K serving as the cathode electrodes, each being arranged side by side.

A positioning means 20 is installed on an upper part of a side wall of the assembly of the electrolytic baths 30.

The embodiment of the overhead traveling crane system shown in FIG. 1 is primarily made up of a moving device 18, a suspension member 16, a lifting device 15, a position guide means 10, and a positioning means 20.

The moving device 18 is a device which horizontally travels in a longitudinal direction X or a lateral direction Y of the assembly of the electrolytic baths 30 arranged side by side (in FIG. 1, only a plurality of electrolytic baths 30 in the lateral direction Y are illustrated). The moving device 18 has a slider 18*c*, which travels in the X-axis direction on rails 18*b* and is equipped with a motor 18*a*. Moreover, the rails 18*b* are laid in a frame which is not shown in the figures and this frame travels in the Y-axis direction.

Attached to the lower surface of the slider 18*c* is a pair of first cylindrical guide members 18*d*, which have flared parts located at their lower ends. The suspension member 16 is suspended from the lower surface of the slider 18*c* by means of first wires 16*b* wound by two motors (not shown in the figures).

A pair of first guide bars 16*a* is vertically provided on the upper surface of the suspension member 16 and is to be inserted into the pair of first cylindrical guide members 18*d* attached to the lower surface of the slider 18*c*. This prevents the suspended suspension member 16 from swinging due to inertia force caused when the moving device 18 is moved horizontally.

A pair of second cylindrical guide members 16*d* is attached to the lower surface of the suspension member 16. The lower ends of the second cylindrical guide members 16*d* are flared so as to gradually extend outward.

The lifting device 15 is attached to the lower surface of the suspension member 16 in a suspended fashion so as to be elevated by second wires 15*b* wound by a motor, which is not shown.

A pair of second guide bars 15*a* is provided vertically on the upper surface of the lifting device 15, and is to be inserted into the second cylindrical guide members 16*d* attached to the lower surface of the suspension member 16.

This, as described above, prevents the swinging of the lifting device 15 when the moving device 18 travels horizontally.

The upper ends of the second guide bars 15*a* are supposed to be placed in the flared parts of the second cylindrical guide members 16*d* immediately after the lifting device 15 arrives at a given position and descends so that the position guide means 10 starts to engage with the positioning means 20.

Until the position guide means 10 and the positioning means 20 completely engage with each other, the upper ends of the second guide bars 15*a* are movable inside the flared parts of the second cylindrical guide members 16*d*.

The positioning means 20 provided on the top of the side walls of the assembly of electrolytic baths 10 engages with the position guide means 10 provided on both sides of the lifting device 15.

In the present embodiment, the suspension member 16 is interposed between the moving device 18 and the lifting device 15, but it is not limited to that way. It is also possible to install the lifting device 15 directly on the moving device 18.

The positioning means 20 are provided on the top of the side walls of the assembly of the electrolytic baths 30 and are located so that magnetic sensors can be accurately placed in given positions for measuring magnetic flux close to the cathode plates K and/or anode plates A at the moment the engagement of the positioning means 20 with the position guide means 10 is completed.

In the present embodiment, engaging members 20a having a conical shape are attached to the hems of the positioning means 20.

The position guide means 10 have flared concave portions, which engage with the engaging members 20*a* and have a width slightly greater than the maximum positioning error (±10 mm to ±75 mm) of the moving device 18.

Figure 2A:
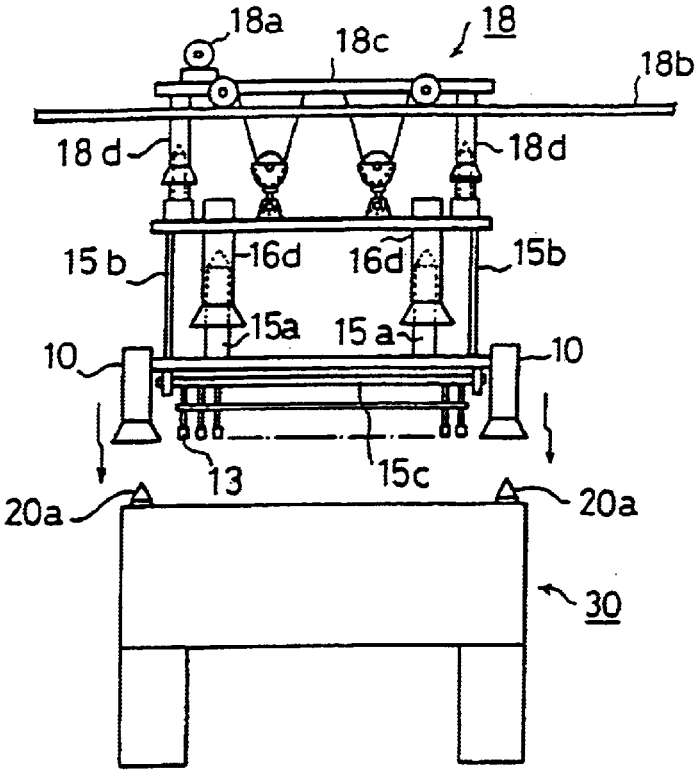
FIGS. 2(*a*), 2(*b*), and 2(*c*) are side views that explain a positioning movement of the overhead traveling crane system in FIG. 1, wherein FIG. 2(*a*) is a side view of a version in which the position guide members have flared ends before engagement, and FIG. 2(*b*) is a side view of the one version after engagement, and FIG. 2(*c*) is a side view of another version in which the positioning members have flared ends after engagement.
Figure 2B:
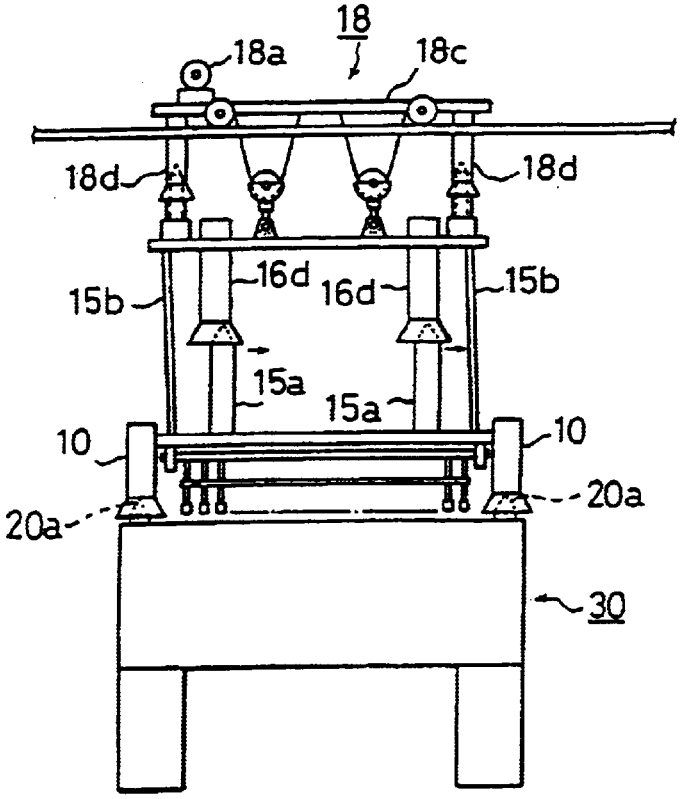
Figure 2C:
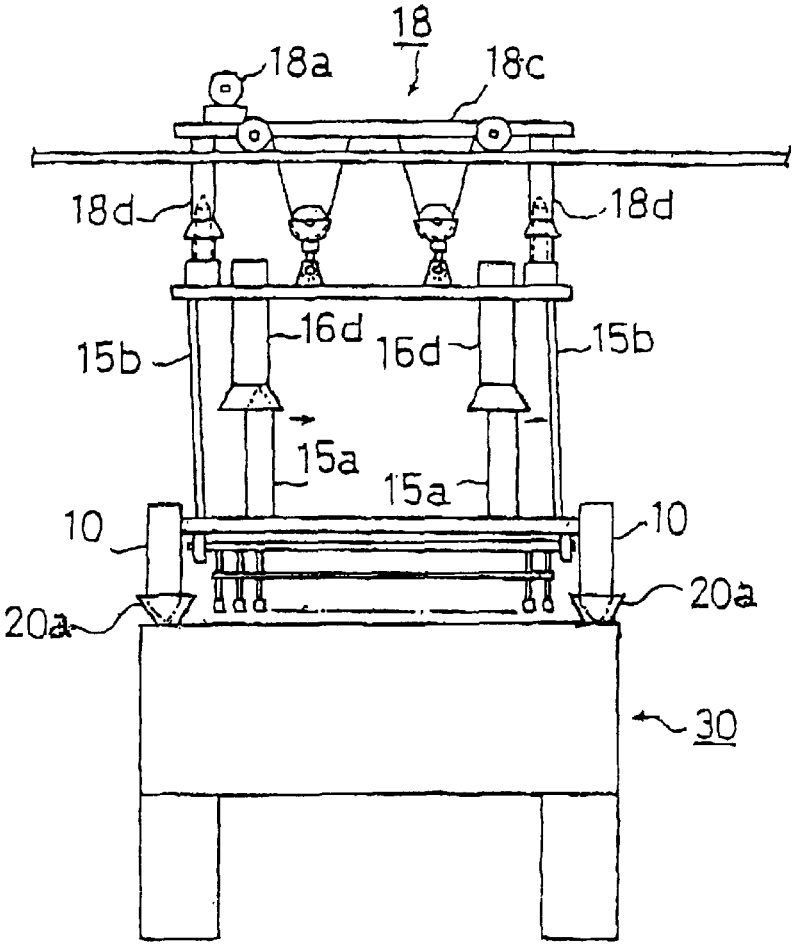
Figure 3:
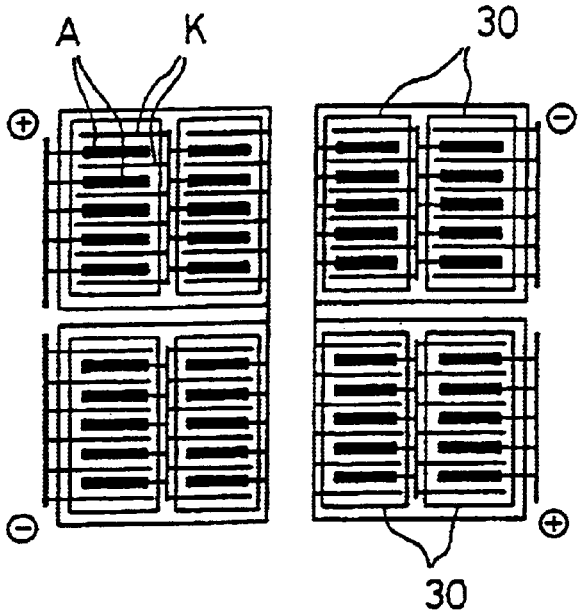
FIG. 3 is a schematic plan view to explain an electric supply system to an electrolytic bath.
Figure 4:
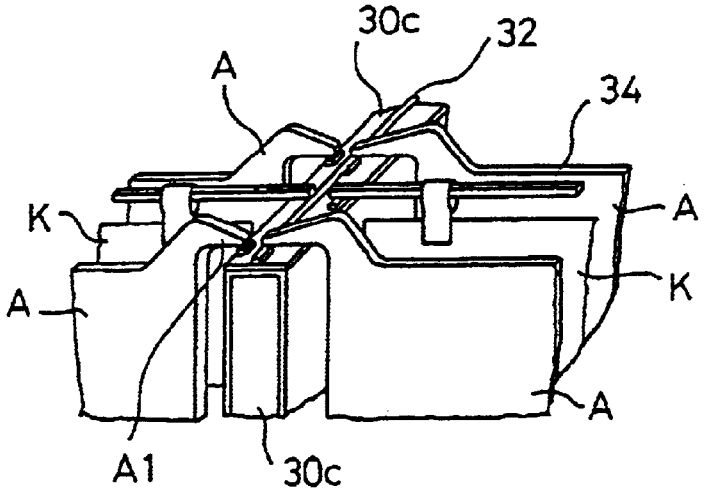
FIG. 4 is a perspective view of an electric supply part connected to anode plates and cathode plates in an electrolysis refinery.

As another embodiment of the present invention, as shown in FIG. 2(*c*), it is possible to form counter-cone-shaped engaging members 20*a*' on the hems of the positioning means 20. In this case, it is required to provide the position guide means 10 with positioning convex portions corresponding to the counter-cone-shaped engaging members so as to engage therewith.

Furthermore, in case the facing side walls of the electrolytic baths 30 have different heights, it is required to adjust the installing positions of the position guide means 10 and the engaging member 20*a* and save data on the adjusted positions in a memory.

As another embodiment of the present invention, it is possible to form counter-cone-shaped engaging members 20*a* on the hems of the positioning means (20). In this case, it is required to provide the position guide means 10 with positioning convex portions corresponding to the counter-cone-shaped engaging members 20*a* so as to engage therewith. Next, a description will be given of an operation of the above-mentioned error detection system.

A frame, which is not shown in figures, and/or the slider 18*c* is moved horizontally so that the lifting device 15 is moved over the target electrolytic bath 30. If there is an obstacle during the traveling, the second wires 15*b* are wound up and simultaneously the first wires 16*b* are wound up in order to adjust the height of the lifting device 15. The moving device stops moving when arriving at the given position. The first cylindrical guide members 18*d* and the second cylindrical guide members 16*d* suppress the lifting device 15 from swinging caused by the inertia resulting from the movement of the moving device 18.

Thereafter, the elevation motor, which is not shown in the figures, is operated, and the second wires 15*b* are wound down, so that the lifting device 15 descends.

When the lifting device 15 descends, the flared parts of the position guide means 10 come close to the engaging members 20*a*, and the engagement begins. At that time, the upper ends of the second guide bars 15*a* are placed at the flares of the second cylindrical guide members 16*d*.

The lifting device 15 keeps descending, and the flared parts of the position guide means 10 move along with the conical engaging members 20*a* to the given positions. The position of the lifting device 15 is controlled to minutely move horizontally so that the large number of magnetic sensors 13 is accurately arranged in given positions close to the cathode plates K and/or the anode plates A. Along with the minute movement of the lifting device 15, the top ends of the second guide bars 15*a* minutely move inside the flared parts of the second cylindrical guide members 16*d*.

After the measurement of the magnetic flux is done, the second wires 15*b* are wound up to lift the lifting device 15. Then, the moving device 18 is operated to move horizontally and the lifting device 15 is moved over the next target electrolytic bath 30. The above operation is repeated.

According to the overhead traveling crane system of the present invention, the position guide means is provided to the lifting device 15 which is suspended from the general-purpose overhead traveling crane system installed in normal factories, and engages with the positioning means 20 provided in the given position on the target. The above arrangement allows precise positioning in the lateral direction. Thus, the positioning precision of the general-purpose overhead traveling crane system may be as it is conventionally, but it is possible to accurately control the position of the lifting device accurately in the horizontal direction.

Moreover, the guide bars provided to the lifting device are arranged in such a way as to be inserted into the guide members installed on the overhead traveling crane system, and it is thus possible to prevent the swinging of the lifting device influenced by the inertia caused by the movement of the crane itself.

Since the general-purpose overhead traveling crane system is used without adopting a swinging control such as fuzzy motion control, the invention allows the system to operate at a high traveling rate and does not demand much cost.

What is claimed is:

1. An overhead traveling crane system comprising:

a moving device arranged to be movable in a horizontal direction on an upper track over a target on the ground, a lifting device suspended by wires from the moving device so that it can be raised to and lowered from the moving device vertically by operation of the wires, a target on the ground over which the lifting device is moved to an approximately correct horizontal position by the moving device on the upper track, said lifting device having a lower surface for supporting an object therefrom which is to be lowered to the target in a precise horizontal position thereon, a pair of cylindrical guide members attached to the moving device having flared open ends extending vertically toward an upper surface of the lifting device, and a pair of guide bars attached to the upper surface of the lifting device extending vertically toward the cylindrical guide members on the moving device, wherein when the lifting device is raised vertically to the moving device by operation of the wires, the guide bars on the upper surface of the lifting device are guided and inserted into the cylindrical guide members and held therein to minimize swinging motion of the lifting device after it is moved in a horizontal direction by the moving device over the target, and a pair of position guide members attached to the lower surface of the lifting device having guide ends extending vertically toward the target, and a pair of positioning members attached on side walls of the target having mating ends extending vertically toward the position guide members on the lifting device, wherein when the lifting device is lowered vertically from the moving device by operation of the wires, the position guide members on the lifting device are guided and held by the mating ends of the positioning members on the target in a precise horizontal position on the target, wherein said pair of cylindrical guide members attached to the moving device are positioned relative to said pair of guide bars attached to the upper surface of the lifting device, and wherein said pair of position guide members attached to the lower surface of the lifting device are positioned relative to said pair of positioning members attached on side walls of the target such that said guide bars engage in the flared ends of the cylindrical guide members as said position guide members start to complete their guiding and mating movement with said positioning members in a precise horizontal position on the target, and wherein the tips of said guide bars are positioned inside the flared ends of the cylindrical guide members when said position guide members complete their guiding and mating movement with said positioning members so that they may move with a slight horizontal adjustment movement in the flared ends.

2. An overhead traveling crane system according to claim 1, wherein said positioning members on the target have conical shaped ends, and the position guide members attached to the lifting device have concave shaped ends that mate with the conical shaped ends of the positioning members.

3. An overhead traveling crane system according to claim 1, wherein said positioning members on the target have inverted cone shaped ends, and the position guide members attached to the lifting device have convex shaped ends that mate with the inverted cone shaped ends of the positioning members.

4. An overhead traveling crane system according to claim 1, wherein said pair of guide bars and pair of position guide members are attached to opposite ends of the surfaces of the lifting device in the horizontal direction.

5. An overhead traveling crane system comprising:

a moving device arranged to be movable in a horizontal direction on an upper track over a target on the ground, a lifting device suspended by wires from the moving device so that it can be raised to and lowered from the moving device vertically by operation of the wires, a target on the ground over which the lifting device is moved to an approximately correct horizontal position by the moving device on the upper track, said lifting device having a lower surface for supporting an object therefrom which is to be lowered to the target in a precise horizontal position thereon, a pair of cylindrical guide members attached to the moving device having flared open ends extending vertically toward an upper surface of the lifting device, and a pair of guide bars attached to the upper surface of the lifting device extending vertically toward the cylindrical guide members on the moving device, wherein when the lifting device is raised vertically to the moving device by operation of the wires, the guide bars on the upper surface of the lifting device are guided and inserted into the cylindrical guide members and held therein to minimize swinging motion of the lifting device after it is moved in a horizontal direction by the moving device over the target, and a pair of position guide members attached to the lower surface of the lifting device having guide ends extending vertically toward the target, and a pair of positioning members attached on side walls of the target having mating ends extending vertically toward the position guide members on the lifting device, wherein when the lifting device is lowered vertically from the moving device by operation of the wires, the position guide members on the lifting device are guided and held by the mating ends of the positioning members on the target in a precise horizontal position on the target, wherein the upper surface of the lifting device is formed as a suspension member, and the lower surface of the lifting device is suspended by a second set of wires from the suspension member, and the suspension member has a pair of second cylindrical guide members attached thereto having flared open ends extending vertically toward the suspended lower surface of the lifting device, and a pair of second guide bars are attached to the suspended lower surface of the lifting device extending vertically toward the second cylindrical guide members on the suspension member, wherein when the suspended lower surface of the lifting device is raised vertically to the suspension member by operation of the second set of wires, the second guide bars on the suspended lower surface of the lifting device are guided and inserted into the second cylindrical guide members and held therein to minimize swinging motion of the suspended lower surface of the lifting device after it is moved in a horizontal direction over the target.

6. An overhead traveling crane system comprising:

a moving device arranged to be movable in a horizontal direction on an upper track over a target on the ground, a lifting device suspended by wires from the moving device so that it can be raised to and lowered from the moving device vertically by operation of the wires, a target on the ground over which the lifting device is moved to an approximately correct horizontal position by the moving device on the upper track, said lifting device having a lower surface for supporting an object therefrom which is to be lowered to the target in a precise horizontal position thereon, a pair of cylindrical guide members attached to the moving device having flared open ends extending vertically toward an upper surface of the lifting device, and a pair of guide bars attached to the upper surface of the lifting device extending vertically toward the cylindrical guide members on the moving device, wherein when the lifting device is raised vertically to the moving device by operation of the wires, the guide bars on the upper surface of the lifting device are guided and inserted into the cylindrical guide members and held therein to minimize swinging motion of the lifting device after it is moved in a horizontal direction by the moving device over the target, and a pair of position guide members attached to the lower surface of the lifting device having guide ends extending vertically toward the target, and a pair of positioning members attached on side walls of the target having mating ends extending vertically toward the position guide members on the lifting device, wherein when the lifting device is lowered vertically from the moving device by operation of the wires, the position guide members on the lifting device are guided and held by the mating ends of the positioning members on the target in a precise horizontal position on the target, wherein said pair of cylindrical guide members attached to the moving device are positioned relative to said pair of guide bars attached to the upper surface of the lifting device, and said pair of position guide members attached to the lower surface of the lifting device are positioned relative to said pair of positioning members attached on side walls of the target such that said guide bars engage in the flared ends of the guide members so that they may move with a slight horizontal adjustment movement in the flared ends as said position guide members start completing their guiding and mating movement with said positioning members in a precise horizontal position on the target, and adapted for use in an electrolysis refinery facility, wherein the target is a precisely spaced, horizontal array of electrolytic baths, and the lower surface of the lifting device supports an array of magnetic sensors for detecting magnetic flux densities of cathode and/or anode plates in the electrolytic baths.

* * * * *